US005855288A

United States Patent [19]

Dallas, Jr.

[11] Patent Number: 5,855,288

[45] Date of Patent: Jan. 5, 1999

[54] RESEALABLE CLOSURE

[75] Inventor: Milton R. Dallas, Jr., East Troy, Wis.

[73] Assignee: AptarGroup, Inc., Crystal Lake, Ill.

[21] Appl. No.: 889,303

[22] Filed: Jul. 8, 1997

[51] Int. Cl.[6] ..... B65D 45/32; B65D 51/12

[52] U.S. Cl. ..... 215/228; 215/235; 215/250; 215/270; 215/306; 215/320; 215/354; 220/212; 220/233; 220/259; 220/305

[58] Field of Search ..... 215/228, 231, 215/235, 250, 252, 253, 258, 270, 271, 303, 305, 306, 320, 321, 354; 220/212, 231, 233, 256–259, 305, 269, 270, 277, 278, 281, 283, 375

[56] References Cited

U.S. PATENT DOCUMENTS

| | | | |
|---|---|---|---|
| 1,706,561 | 3/1929 | Church . | |
| 3,690,504 | 9/1972 | Ragettli | 220/305 |
| 4,027,776 | 6/1977 | Douglas | 220/281 |
| 4,303,171 | 12/1981 | Schremmer . | |
| 4,564,113 | 1/1986 | Mendler | 215/252 |
| 4,574,966 | 3/1986 | Sandhaus . | |
| 4,640,429 | 2/1987 | Sandhaus | 215/320 |
| 4,714,167 | 12/1987 | Sandhaus . | |
| 4,771,905 | 9/1988 | Perne et al. . | |
| 4,807,769 | 2/1989 | Gach . | |
| 4,948,003 | 8/1990 | Munoz . | |
| 4,979,843 | 12/1990 | Perry | 220/305 X |
| 5,147,059 | 9/1992 | Olsen et al. | 220/281 |
| 5,251,770 | 10/1993 | Bartley et al. . | |
| 5,373,955 | 12/1994 | Marino . | |
| 5,460,287 | 10/1995 | Cargile et al. . | |
| 5,597,096 | 1/1997 | Jeppesen et al. | 220/281 X |
| 5,636,756 | 6/1997 | Johnson | 215/305 X |
| 5,722,562 | 3/1998 | Kick | 215/320 X |

*Primary Examiner*—Stephen K. Cronin
*Assistant Examiner*—Nathan Newhouse
*Attorney, Agent, or Firm*—Rockey, Milnamow & Katz, Ltd.

[57] ABSTRACT

A combination of a container and a lid is provided. The container has an inner peripheral surface around an opening to the container interior. The lid is movable between (1) a closed position to cover the opening, and (2) an open position to expose the opening. The lid has (a) a peripheral wall, (b) a peripheral hinge that extends from the wall, (c) a plug seal wall that extends from the peripheral hinge, and (d) a central portion that extends from the plug seal wall. When the lid is in a closed position, the lid is displaceable from an outwardly projecting configuration wherein the plug seal wall is held in a non-sealing condition disengaged from the inner peripheral surface to an inwardly deformed configuration wherein the plug seal wall is held in a sealing condition engaged with the inner peripheral surface.

27 Claims, 4 Drawing Sheets

RESEALABLE CLOSURE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to containers and closures. The invention is more particularly related to a sealable closure which is especially suitable for use with a wide-mouth container of product that can be scooped from or poured from the container when the closure lid is opened.

BACKGROUND OF THE INVENTION AND TECHNICAL PROBLEMS POSED BY THE PRIOR ART

Various product packaging designs employ closures with one or more barriers or seals across an opening to the package. Such seals can serve as primary or secondary barriers to contaminant ingress. Such seals may also maintain product freshness. In addition, such seals may provide a tamper-indicating function wherein breaking or removing the seal provides evidence that the package has been opened.

Examples of a closure with an internal tamper-indicating seal are disclosed in U.S. Pat. Nos. 4,948,003 and 4,807,769. These types of closures include a base for mounting the closure to the container. The base includes a pour spout. The pour spout is initially occluded by a sealing disk or member. The periphery of the sealing disk defines a reduced cross-sectional thickness of material which functions as a frangible web connecting the sealing disk to a radially outward region of material. An exterior portion of the sealing disk may include a pull tab which is grasped by a user's fingers for ripping the sealing disk out of the pour spout. The closure also includes a hinged lid with an internal collar to telescopically receive the pour spout in sealing engagement when the lid is closed so as to provide a liquid-tight and airtight system after the sealing disk has been removed.

While closures of the above-discussed type may function generally satisfactorily in applications for which they are intended, it would desirable to provide an improved closure with enhanced features.

For example, some containers, such as jars for peanut butter and other such paste-like products, typically have a relatively wide mouth. It would be desirable to provide an improved closure which could extend over the wide mouth of such a container and which would have a lid that could be opened and closed to permit access to the container interior.

Further, it would be desirable if such an improved closure could include means for retaining the lid with the closure when the lid is open. Further, it would be advantageous if such an improved closure could include means for providing tamper-indication that would furnish evidence that the lid has been opened or at least that could provide evidence of tampering with the lid.

Some types of containers, especially containers designed for food products or pharmaceutical products, include a thin, flat paper or film liner secured to the top of the container across the mouth of the container. The liner must be broken and/or removed in order to permit the container contents to be accessed. Such a liner has a tamper-indicating function. Such a liner also serves to prevent contaminant ingress and maintain product freshness. It would be desirable to provide an improved closure which could accommodate the use of such a liner initially on the container and which could, after removal of the liner, provide a re-sealing function. Preferably, such an improved closure should accommodate the use of existing liner technology.

Also, it would be desirable if such an improved closure could be provided with a design that would accommodate efficient, high quality, large volume manufacturing techniques with a reduced product reject rate.

Further, such an improved closure should advantageously accommodate its use with a variety of conventional containers having a variety of conventional container finishes, such as conventional threaded or snap-fit attachment configurations. Such an improved closure design should also optionally accommodate the incorporation of the closure as a unitary part of the container.

The present invention provides an improved closure which can accommodate designs having the above-discussed benefits and features.

SUMMARY OF THE INVENTION

According to the present invention, an improved closure structure is provided for an opening to a container interior. The closure structure includes a lid which is easily manipulated by the user to an open position and which can be readily closed to seal the opening. The closure structure of the present invention is adapted to at least reseal an inner peripheral surface defined around the container opening. Preferably, the closure is also provided with an optional, tamper-indicating, frangible web which can be torn when the lid is initially opened.

According to one aspect of the invention, a combination of container and lid is provided. The container has an inner peripheral surface around an opening to the container interior. The lid is provided for movement between (1) a closed position to cover the opening and(2)an open position to expose the opening. The lid has (a) a peripheral wall, (b) a thin, pivotal, peripheral section or hinge that extends from the peripheral wall, (c) a plug seal wall that extends from the peripheral hinge, and (d) a central portion that extends from the plug seal wall. When the lid is in the closed position, the central portion can be displaced from an outwardly projecting configuration, wherein the plug seal wall is held in a non-sealing condition disengaged from the inner peripheral surface, to an inwardly deformed configuration, wherein the plug seal wall is held in a sealing condition sealingly engaged with the inner peripheral surface.

In a preferred embodiment, the combination further includes (1) a liner across the mouth of the container, and (2) a lower closure portion around the container opening below the lid. The lower closure portion is separate from, but attachable to, the container. The lid is preferably connected to the lower closure portion with a hinge and also with a frangible, reduced thickness section of material.

The invention may also be alternatively characterized as providing a closure for a container that has an inner peripheral surface around an opening to the container interior. The closure includes a lower closure portion for extending around the container opening. The closure includes a lid which is movable between (1) a closed position on the lower closure portion to cover the opening, and (2) an open position relative to the lower closure portion to expose the opening. The lid has a peripheral wall. A thin, pivotal, peripheral section or hinge extends from the peripheral wall to a plug seal wall. The plug seal wall extends from the peripheral hinge to a central portion. The central portion occupies the central portion of the closure and is displaceable from an outwardly projecting configuration to an inwardly deformed configuration. In the outwardly projecting configuration, the plug seal wall is held in a non-sealing condition disengaged from the container inner peripheral surface. When the lid central portion is in the inwardly deformed configuration, the plug seal wall is held in a sealing condition sealingly engaged with the container inner peripheral surface.

The closure can be used with or without a liner secured across the top of the mouth of the container. Further, the lower portion of the closure may be formed as a unitary part or extension of the container.

The lid may be an element separate from, but mountable on, the lower closure portion. Preferably, the lower closure portion and closure lid are molded together as a unitary combination connected at a rear portion of the closure by an axis-defining hinge, and the lid and lower closure portion are further initially connected around the remaining periphery of the closure by a frangible web that must be broken in order to open the lid.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure elements or components of this invention are described in various positions, and terms such as upper, lower, horizontal, etc., are used with reference to these positions. It will be understood, however, that the closure components may be manufactured and stored in orientations other than the ones described.

Figure 1:
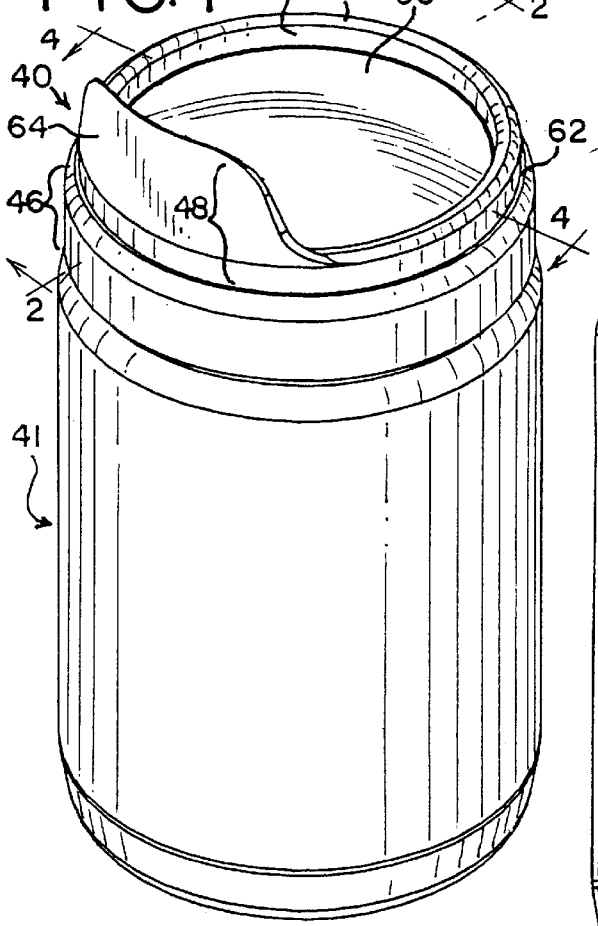
FIG. 1 is a front, perspective view of a first embodiment of a closure of the present invention shown with the lid closed with a frangible web intact.
Figure 2:
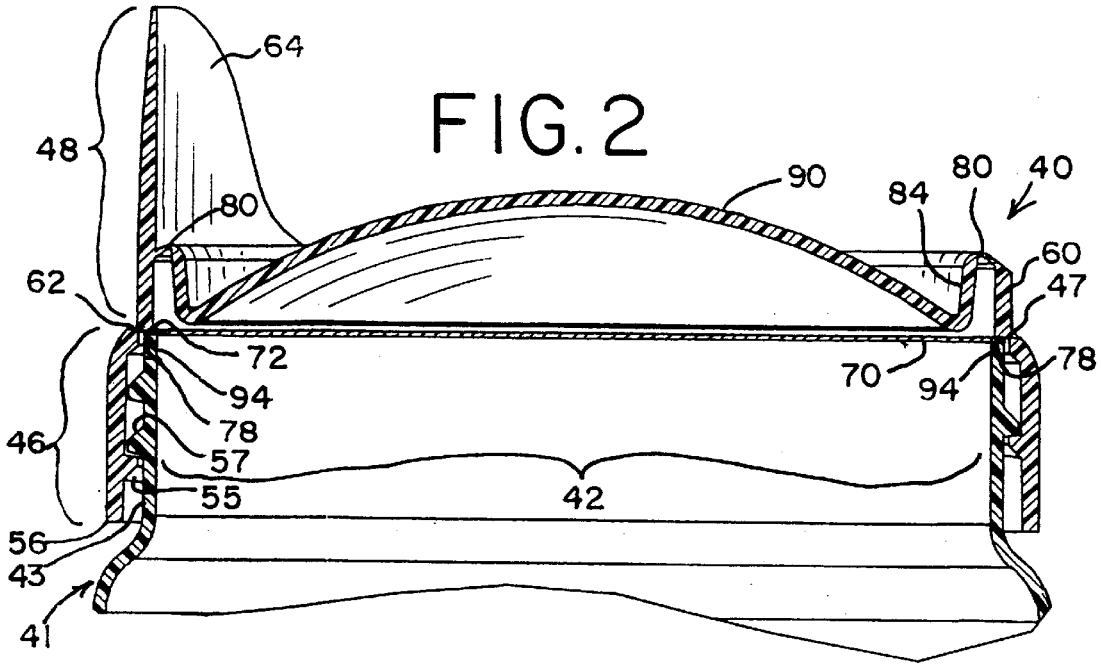
FIG. 2 is a fragmentary, cross-sectional view of the closure taken generally along the plane 2—2 in FIG. 1.

With reference to the figures, a first embodiment of a closure structure of the present invention is illustrated in FIGS. 1–7 wherein a separately formed closure is represented generally in the figures by reference number 40. As shown in FIG. 2, the closure 40 is adapted to be disposed on a container 41 which has a mouth or opening 42. The opening 42 is typically defined by a neck 43 or other suitable structure at the top of the container 41. The neck 43 typically has (but need not have) a circular cross-sectional configuration, and the body of the container 41 may have another cross-sectional configuration, such as an oval cross-sectional shape, for example. The container 41 need not have a separately identifiable neck 43 per se. The container 41 could instead have just a main body portion terminating in an upper end.

The container 41 may have a rigid wall or walls. Also, the container 41 may be a squeezable container having a flexible wall or walls.

The closure 40 includes a base or lower closure portion 46 and a lid 48. The lower closure portion 46 can be readily injection-molded from thermoplastic materials compatible with the container contents.

In the first embodiment illustrated in FIGS. 1–7, the lower closure portion 46 includes an annular skirt or wall 56 which may have suitable connecting means (e.g., a conventional thread 55 (or conventional snap-fit bead which is not illustrated)) for engaging suitable cooperating means (e.g., a thread 57 (or groove which is not shown)) to secure the lower closure portion 46 to the container 41. The lower closure portion 46 and container 41 could also be welded together by induction melting or ultrasonic melting.

The closure lid 48 may be an entirely separate piece unconnected to the lower closure portion 46. Preferably, a hinge 47 (FIGS. 2 and 3) is provided for connecting the lid 48 to the lower closure portion 46 to form a unitary structure.

Figure 3:
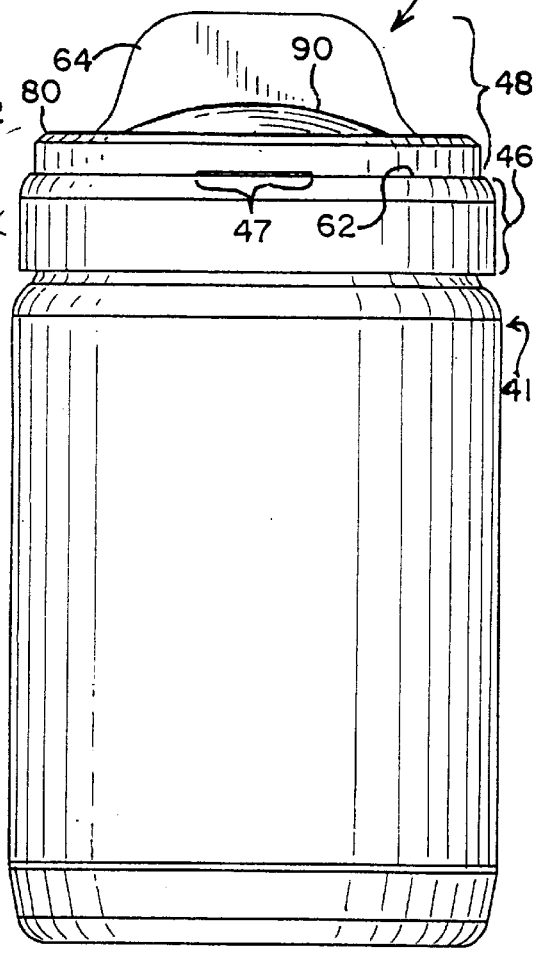
FIG. 3 is a rear elevational view of the closure.

In the preferred embodiment, the lid 48 includes a peripheral wall 60 having an annular, cylindrical configuration. The wall 60 has a lower edge which, at the rear of the closure as shown in FIGS. 3 and 2, merges with the hinge 47 along the top of the hinge 47. The bottom of the hinge 47 merges with the lower closure portion 46. As shown in FIG. 3, the hinge 47 extends for only a short distance across the rear portion of the closure and may define a generally linear pivot axis.

Figure 5:
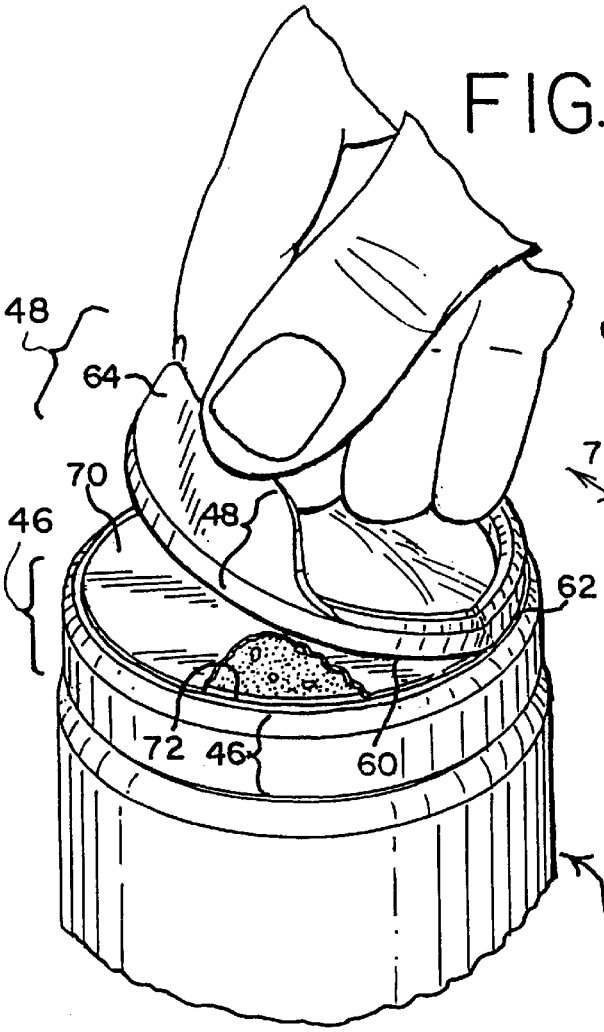
FIG. 5 is a fragmentary, perspective view similar to FIG. 1, but FIG. 1 shows a lid being opened by tearing the frangible web.
Figure 6:
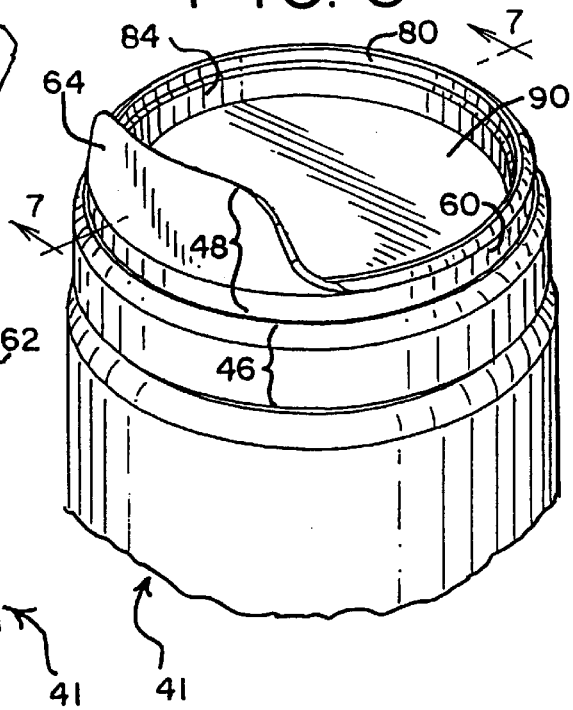
FIG. 6 is a view similar to FIG. 5, but FIG. 6 shows the lid re-closed in a sealing condition.

On either side of the hinge 47, the lid wall 60 is also preferably initially connected to the top of the wall 56 of the lower closure portion 46 by means of 10 a frangible, reduced thickness section of material or web 62 (FIGS. 1–3). The first time that the closure 40 is opened, the frangible web 62 is torn away as the lid 48 is lifted. Specifically, the lid 48 includes an upwardly projecting gripping tab 64 (FIGS. 1–7)

which can be grasped by the user as shown in FIG. 5 and pulled upwardly and rearwardly relative to the front of the closure. The upward pulling force causes the frangible web 62 to tear along two opposite directions around the circumference of the lid 48 to the rear hinge 47 (FIG. 3). The frangible web 62 terminates at each lateral end of the hinge 47, and the tearing process cannot continue into the hinge 47 which has a greater thickness that resists tearing.

When the frangible web 62 has been torn from the front of the closure all the way around to both lateral ends of the hinge 47 at the rear of the closure, the lid 48 remains connected to the lower closure portion 46 only by the hinge 47. The hinge 47 permits the lid to be moved to an open position which may be 90°, or even 180° or more, from the initial closed position illustrated in FIG. 1.

Figure 4:
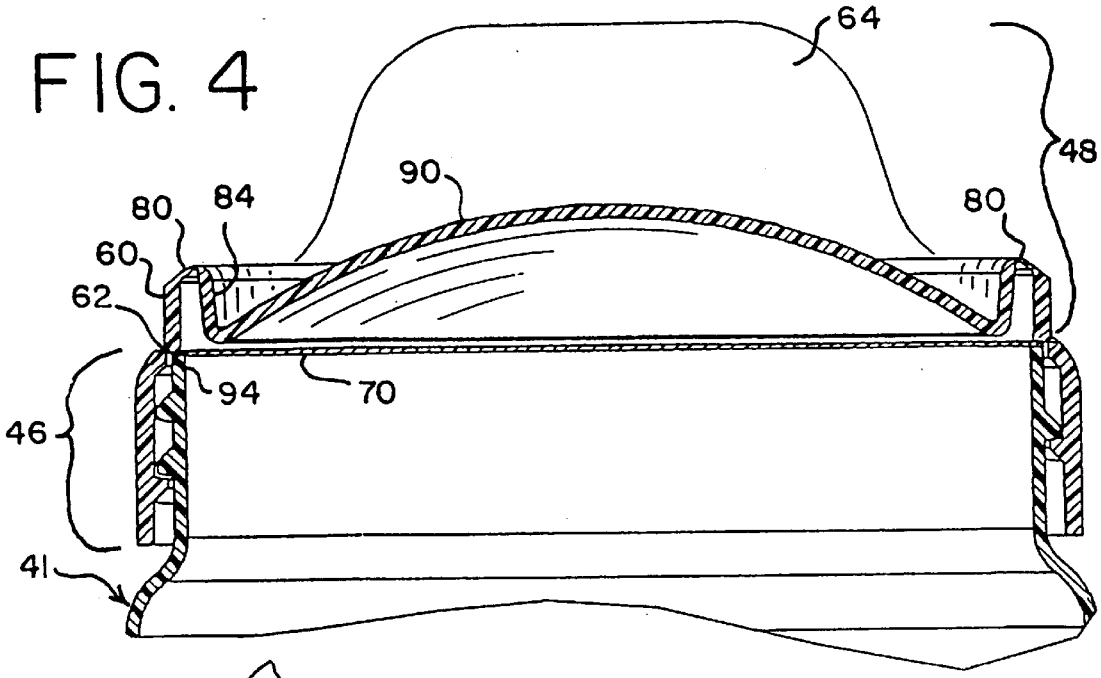
FIG. 4 is a fragmentary, cross-sectional view taken generally along the plane 4—4 in FIG. 1.

As shown in FIGS. 2 and 4, a thin, flat paper or film liner 70 may optionally be provided. Preferably, the liner 70 is positioned across the container opening 42. As shown in FIG. 5, the container neck 43 defines an annular, flat, top surface 72 for receiving and supporting the peripheral margin of the liner 70. Preferably, the liner 70 is secured, as with adhesive or heat-sealing, to the surface 72. The liner 70 must be broken and/or removed in order to permit the container contents to be accessed. The liner 70 can provide a tamper-indicating function and can also serve to prevent contaminant ingress and to maintain product freshness.

With reference to FIG. 2, it will also be appreciated that the lid peripheral wall 60 has an annular, bottom, flat surface 78 for engaging the top surface of the peripheral margin of the liner 70. If a liner 70 is not employed, the closure can be designed so that the lid annular, bottom surface 78 directly engages the container annular, top surface 72 (FIGS. 2 and 5). If the liner 70 is employed, the liner 70 may be secured to the container top surface 72 in a way that permits the liner 70 to be completely removed from the top surface 72. With such a design, the lid annular bottom surface 78 may engage the container top surface 72 after removal of the liner 70.

After the lid 48 is opened (and, if a liner 70 is employed, after the liner 70 is completely or at least partially removed), access is provided to the container interior for removal of some or all of the contents. Subsequently, the lid 48 can be closed. The lid 48 includes a novel structure which permits the container to be resealed as next explained in detail.

The lid 48 includes a thin, pivotal, peripheral section or hinge 80 (FIGS. 1–4 and 6–7) which extends from the top of the lid peripheral wall 60. The lid 48 also includes a plug seal wall 84 (FIGS. 1, 2, 4, 6, and 7) which extends from the peripheral hinge 80. The lid 48 also has a central portion 90 which extends from the plug seal wall 84.

Figure 7:
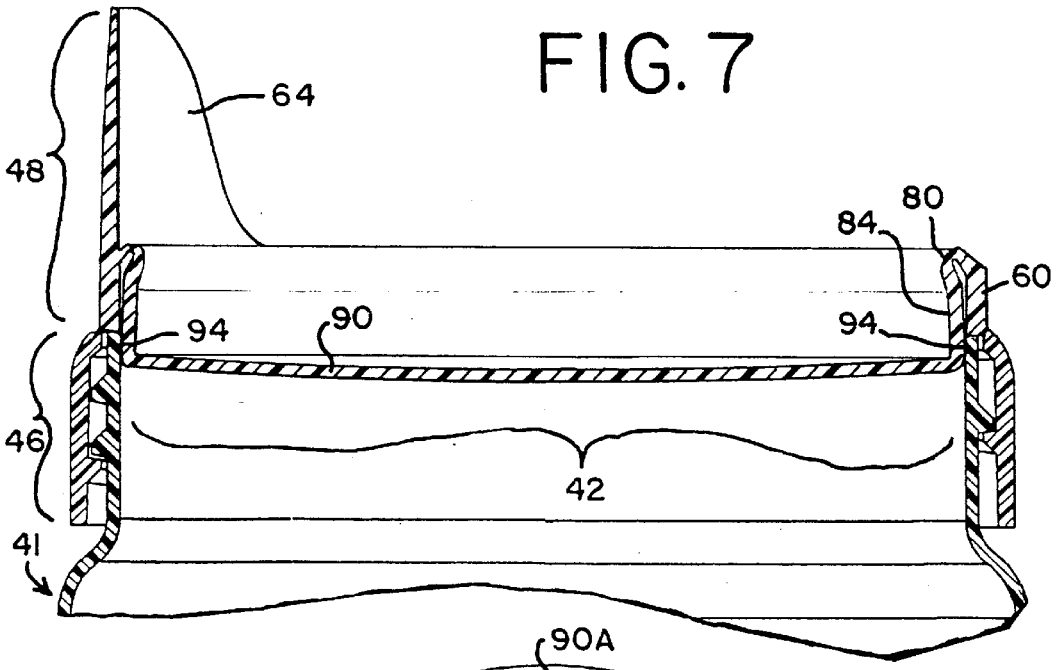
FIG. 7 is a greatly enlarged, fragmentary, cross-sectional view taken generally along the plane 7—7 in FIG. 6.

In the preferred embodiment, the plug seal wall 84 is a generally annular wall, and the central portion 90 has an initially outwardly projecting configuration in the form of a convex dome. The dome or central portion 90 is adapted to be pushed downwardly or inwardly toward the container interior (as shown in FIG. 7) after the lid 48 has been reclosed on the container. The lid 48 is sufficiently flexible, at least in the regions defined by the peripheral hinge 80, plug seal wall 84, and central portion 90, so that the lid 48 assumes, and maintains, a different configuration when the central portion 90 is pushed inwardly. The outwardly projecting central portion 90 flexes, inverts, or collapses from its outwardly projecting configuration to a less outwardly projecting configuration which is inwardly deformed compared to the initial outwardly projecting configuration. As shown in FIG. 7, the central portion 90 preferably is held in a distended, inwardly deformed configuration which forces the plug seal wall 84 radially outwardly into a sealing relationship with the adjacent portion of the container 41 defining the container mouth 42. Preferably, the upper portion of the container 41 defines a smooth, annular, inner peripheral surface 94 which is sealingly engaged by the plug seal wall 84.

By comparing FIG. 2 with FIG. 7, it will be appreciated that the central portion 90 may be characterized as being displaceable between two configurations. One of the configurations establishes a non-sealing condition, and the other of the configurations establishes a sealing condition. In particular, when the lid 48 is in the closed position, the lid central portion 90 can have an outwardly projecting configuration (FIG. 2), wherein the plug seal wall 84 is held in a non-sealing condition disengaged from the container inner peripheral surface 94. However, when the lid central portion 90 is in the inwardly deformed configuration (FIG. 7), then the plug seal wall 84 is held in a sealing condition sealingly engaged with the container inner peripheral surface 94.

Figure 8:
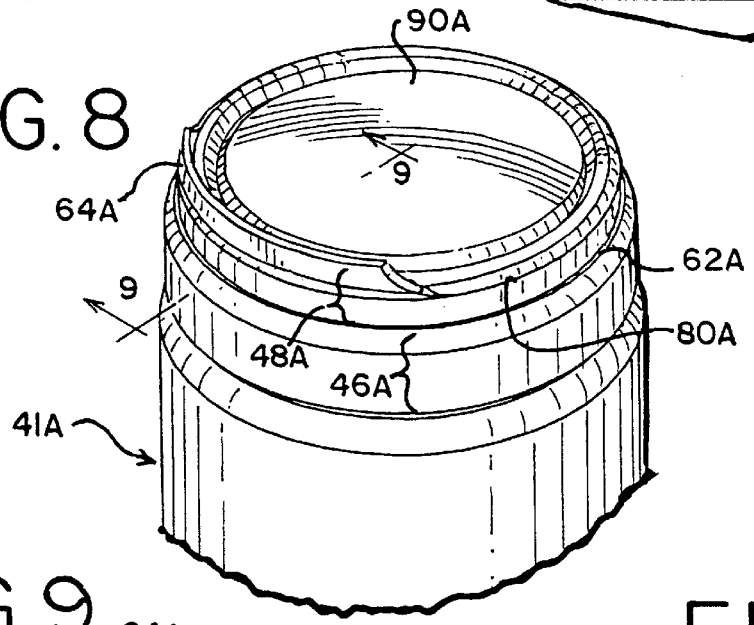
FIG. 8 is a fragmentary, perspective view similar to FIG. 1, but FIG. 8 shows a second embodiment of the closure.
Figure 9:
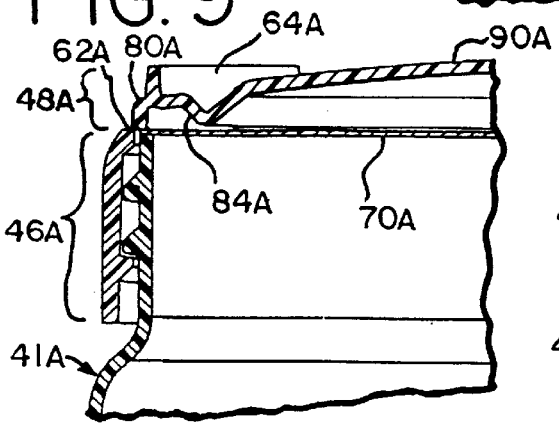
FIG. 9 is a enlarged, fragmentary, cross-sectional view taken generally along the plane 9—9 in FIG. 8.
Figure 10:
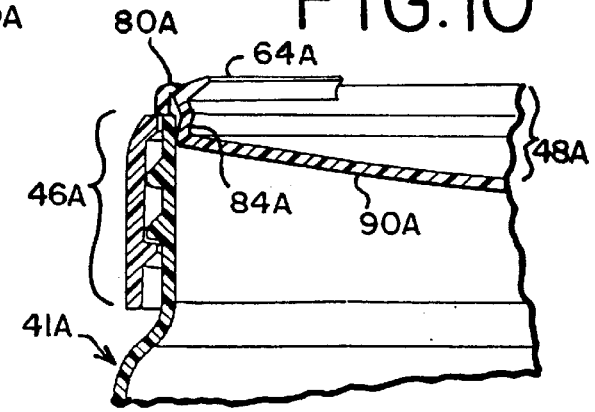
FIG. 10 is a view similar to FIG. 9, but FIG. 10 shows the lid re-closed in a sealing condition.

FIGS. 8–10 illustrate a second embodiment of the closure on a container 41A. The closure includes a lower closure portion 46A and a lid 48A. The structures of the container 41A and lower closure portion 46A are substantially identical with the structures of the container 41 and lower closure portion 46, respectively, described above with reference to the first embodiment illustrated in FIGS. 1–7. However, the lid 48A is somewhat different compared to the first embodiment of the closure lid 48 illustrated in FIGS. 1–7. In particular, the lid 48A has a central portion 90A which is less convex. The lid 48A also has a plug seal wall 84A which is initially slanted or angled toward the axial centerline of the closure. Further, the lid 48A has a gripping tab 64A which is located inwardly of a peripheral hinge 80A.

The lid 48A may be hingedly connected to the lower closure portion 46A with a rear hinge similar to the hinge 47 illustrated in FIGS. 2 and 3 for the first embodiment of the closure. Also, a liner 70A may be mounted across the container 41A below the lid 48A. The lid 48A is also preferably connected to the lower closure portion 46A with a frangible web 62A.

When the lid 48A is initially lifted upwardly to tear the frangible web 62A, the liner 70A may be removed to expose the container contents. Subsequently, the lid 48A may be reclosed, and the central portion 90A may be inwardly deformed or inverted as shown in FIG. 10 to urge the plug seal wall 84A into sealing engagement with the inner peripheral surface of the container 41A. As shown in FIG. 10, when the lid plug seal wall 84A is sealingly engaged with the container 41A, the orientation of the gripping tab 64A is changed so that the gripping tab 64A is tipped or angled rearwardly.

Figure 11:
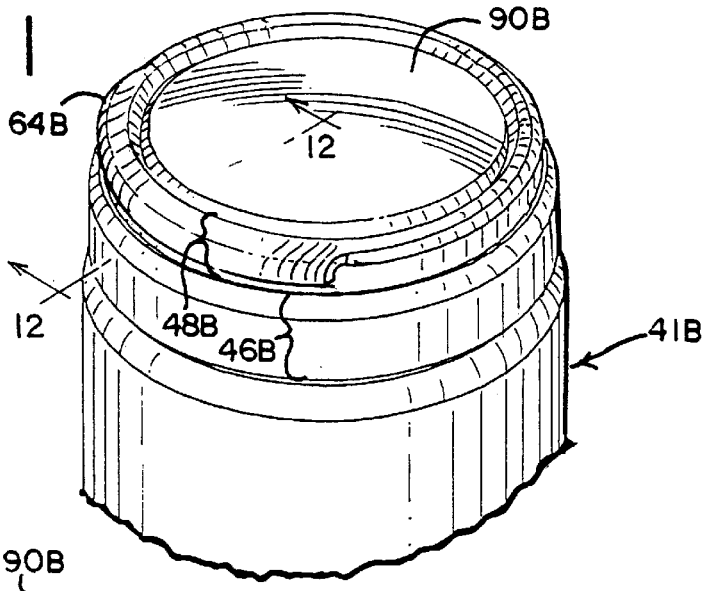
FIG. 11 is a fragmentary, perspective view similar to FIG. 1, but FIG. 11 shows a third embodiment of the closure.
Figure 12:
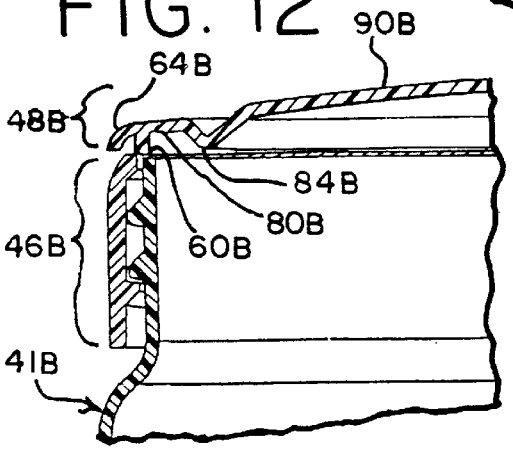
FIG. 12 is a enlarged, fragmentary, cross-sectional view taken generally along the plane 12—12 in FIG. 11.
Figure 13:
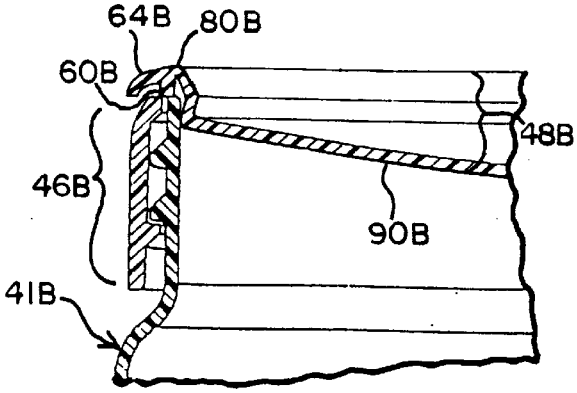
FIG. 13 is a view similar to FIG. 12, but FIG. 13 shows the lid re-closed in a sealing condition.

FIGS. 11–13 illustrate a third embodiment of a closure on a container 41B. The third embodiment is similar to the second embodiment described above with reference to FIGS. 8 and 10. However, a third embodiment includes a gripping tab 64B which projects outwardly from the periphery of the lid 48B. The gripping tab 64B extends outwardly and downwardly toward the lower closure portion 46B. An annular hinge 80B is located inwardly of the gripping tab 64B between a peripheral wall 60B and a plug seal wall 84B. The lid 48B has a central portion 90B which can be inwardly deformed from the position illustrated in FIG. 12 to the position illustrated in FIG. 13. The orientation of the gripping tab 64B does not change.

Figure 14:
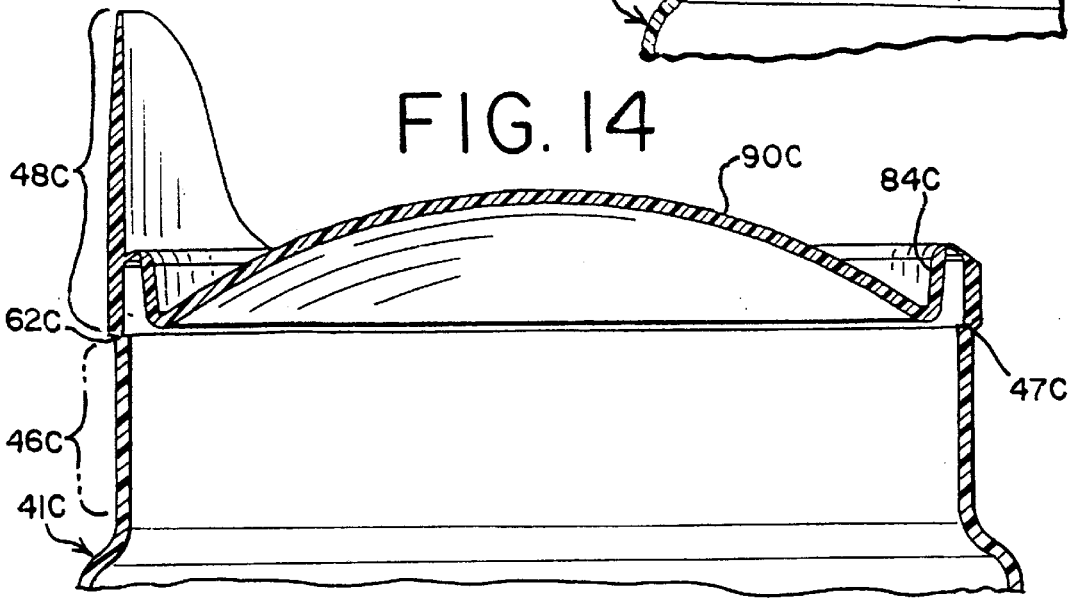
FIG. 14 is a fragmentary, cross-sectional view similar to FIG. 2, but FIG. 14 shows a fourth embodiment of the closure.

FIG. 14 illustrates a third embodiment of the present invention wherein a container 41C may be characterized as incorporating the lower closure portion as a unitary part or portion of the upper part of the container. That is, there is no separately formed lower closure portion, such as lower closure portions 46, 46A, and 46B described above with reference to FIGS. 1–7, FIGS. 8–10, and FIGS. 11–13, respectively. Rather, the upper end of the container 41C is adapted to directly engage the bottom of a lid 48C. Preferably, the lid 48C is initially connected via a frangible web 62C to the upper edge of the container 41C. The rear of the lid 48C may be connected with a hinge 47C to the upper end of the container 41C.

Because the embodiment illustrated in FIG. 14 includes a lid 48C which is directly connected to the top of the container 41C, a secondary seal, such as a liner 70 described above with reference to the embodiment illustrated in FIGS. 1–7, would typically not be employed. After the lid 48C is initially pulled upwardly to break the frangible web 62C and expose the container contents, the lid 48C can be reclosed. The lid 48C includes an initially, outwardly projecting central portion 90C that may be subsequently deformed inwardly to urge a plug seal wall 84C into sealing engagement with the inside surface of the container 41C generally in the same manner as described above with reference to the inward deformation of the lid central portion 90 in the first embodiment illustrated in FIGS. 1–7.

It will be appreciated that if the lid 48C is initially molded with the frangible web 62C as a unitary extension of the top of the container 41C, suitable means must be employed for subsequently filling the container 41C from the bottom and subsequently closing the bottom of the container. To this end, the container 41C could be molded with the closure structure at the top end and with the bottom end open. The container could then be filled through the open bottom end, and then the bottom end of the container could be closed over by suitable means, such as molding the bottom of the container closed or by installing a separately formed bottom closure which could be threaded or snap-fit onto the container bottom. Alternatively, a separate closure could be secured to the container bottom with adhesive or thermal bonding techniques.

With respect to the embodiment illustrated in FIG. 14, the embodiment may be characterized as a closure for a container wherein the closure comprises (1) the lid 48C, and (2) a lower closure portion 46C which is molded as a unitary part or extension of the container 41C. That is, the top of the container 41C may be regarded as including or defining the "lower closure portion 46C." Thus, the phrase "a closure for" as used in the claims may be construed to include either a closure structure (or portion thereof) that is molded as a unitary part or extension of a container (FIG. 14) or a separate closure element adapted to be releasably or permanently mounted to the container (FIGS. 1–13).

It will be readily observed from the foregoing detailed description of the invention and from the illustrations thereof that numerous other variations and modifications may be effected without departing from the true spirit and scope of the novel concepts or principles of this invention.

What is claimed is:

1. A combination of a container and a lid, said combination comprising:

a container having an inner peripheral surface around an opening to the container interior and having an upwardly facing top surface;

a lid movable between (1) a closed position to cover said opening and (2) an open position to expose said opening, said lid having (a) a peripheral wall, (b) a peripheral hinge that extends from said peripheral wall at an elevation spaced above said container top surface, (c) a plug seal wall that extends from said peripheral hinge, and (d) a central portion that extends from said plug seal wall and that, when said lid is in said closed position, is displaceable from an outwardly projecting configuration wherein said plug seal wall is held in a non-sealing condition disengaged from said inner peripheral surface to an inwardly deformed configuration wherein said plug seal wall is held in a sealing condition sealingly engaged with said inner peripheral surface.

2. The combination in accordance with claim 1 further including a lower closure portion around said container opening below said lid; and in which said lower closure portion is separate from, but attachable to, said container; and in which said lid is connected to said lower closure portion with a frangible, reduced thickness section of material.

3. The combination in accordance with claim 2 in which said inner peripheral surface around said opening is defined by an annular cylindrical surface in said container.

4. The combination in accordance with claim 2 in which said container top surface is annular around said opening;

said inner peripheral surface is defined below said top surface;

said lid peripheral wall has an annular bottom surface for engaging said container top surface; and said lower closure portion has a skirt adapted to surround, and be received on, said upper portion of said container.

5. The combination in accordance with claim 4 in which said container upper portion includes a neck defining (1) said opening, (2) said annular top surface, and (3) an external thread form; and said lower closure portion skirt defines an internal thread form for engaging said external thread form.

6. The combination in accordance with claim 1 in which said peripheral hinge is an annular, reduced thickness section of material; and said lid plug seal wall is an annular wall.

7. The combination in accordance with claim 1 in which said outwardly projecting configuration of said lid central portion is a convex dome configuration.

8. The combination in accordance with claim 1 in which inwardly deformed configuration of said lid central portion is slightly inwardly convex.

9. A closure for a container that has an inner peripheral surface around an opening to the container interior and that has an upwardly facing top surface, said closure comprising:

a lower closure portion for extending around said container opening; and a lid movable between (1) a closed position on said lower closure portion to cover said opening and (2) an open position relative to said lower closure portion to expose said opening, said lid having (a) a peripheral wall, (b) a peripheral hinge that extends from said peripheral wall at an elevation spaced above said container top surface, (c) a plug seal wall that extends from said peripheral hinge, and (d) a central portion that extends from said plug seal wall and that, when said lid is in said closed position, is displaceable from an outwardly projecting configuration wherein said plug seal wall is held in a non-sealing condition disengaged from said container inner peripheral surface to an inwardly deformed configuration wherein said plug seal wall is held in a sealing condition sealingly engaged with said container inner peripheral surface.

10. The closure in accordance with claim 9 in combination with said container in which said container top surface is annular and said container has an upper portion defining said annular top surface around said opening;

said container inner peripheral surface is defined below said top surface;

said lid peripheral wall has an annular bottom surface for engaging said container top surface;

said lower closure portion is separate from, but attachable to, said container; and said lower closure portion has a skirt adapted to surround, and be received on, said upper portion of said container.

11. The closure in accordance with claim 10 in combination with said container in which said container upper portion includes a neck defining (1) said opening, (2) said annular top surface, and (3) an external thread form; and said lower closure portion skirt defines an internal thread form for engaging said external thread form.

12. The closure in accordance with claim 9 in which said lower closure portion is separate from, but attachable to, said container.

13. The closure in accordance with claim 9 in which said lower closure portion is molded in one piece with said lid.

14. The closure in accordance with claim 9 in which said peripheral hinge is an annular, reduced thickness section of material.

15. The closure in accordance with claim 9 in which said lid plug seal wall is an annular wall.

16. The closure in accordance with claim 9 in which said outwardly projecting configuration of said lid central portion is a convex dome configuration.

17. The closure in accordance with claim 9 in which inwardly deformed configuration of said lid central portion is slightly inwardly convex.

18. The closure in accordance with claim 9 in which said lid peripheral wall has an outer, peripheral, lower edge; and said lower closure portion is initially connected to a major part of said outer, peripheral, lower edge of said lid peripheral wall with a frangible, reduced thickness section of material.

19. A combination of a container and a lid, said combination comprising:

a container having an inner peripheral surface around an opening to the container interior;

a lid movable between (1) a closed position to cover said opening and (2) an open position to expose said opening, said lid having (a) a peripheral wall, (b) a peripheral hinge that extends from said peripheral wall, (c) a plug seal wall that extends from said peripheral hinge, and (d) a central portion that extends from said plug seal wall and that, when said lid is in said closed position, is displaceable from an outwardly projecting configuration wherein said plug seal wall is held in a non-sealing condition disengaged from said inner peripheral surface to an inwardly deformed configuration wherein said plug seal wall is held in a sealing condition sealingly engaged with said inner peripheral surface;

said combination further including a lower closure portion around said container opening below said lid, said lower closure portion being separate from, but attachable to, said container; and said lid being connected to said lower closure portion with a frangible, reduced thickness section of material, said lower closure portion also being attached to said lid with an axis-defining hinge molded as a connection that is unitary with both said lid and said lower closure portion for accommodating pivoting movement of said lid about said axis between said open and closed positions after said frangible, reduced thickness section of material is broken.

20. A combination of a container and a lid, said combination comprising:

a container having an inner peripheral surface around an opening to the container interior;

a lid movable between (1) a closed position to cover said opening and (2) an open position to expose said opening, said lid having (a) a peripheral wall, (b) a peripheral hinge that extends from said peripheral wall, (c) a plug seal wall that extends from said peripheral hinge, and (d) a central portion that extends from said plug seal wall and that, when said lid is in said closed position, is displaceable from an outwardly protecting configuration wherein said plug seal wall is held in a non-sealing condition disengaged from said inner peripheral surface to an inwardly deformed configuration wherein said plug seal wall is held in a sealing condition sealingly engaged with said inner peripheral surface;

said combination further including a lower closure portion around said container opening below said lid, said lower closure portion being separate from, but attachable to, said container; and said lid being connected to said lower closure portion with a frangible, reduced thickness section of material, said lower closure portion and said lid also being each molded as separate elements whereby said lid can be removed completely from said lower closure portion after said frangible, reduced thickness section of material is broken.

21. A combination of a container and a lid, said combination comprising:

a container having an inner peripheral surface around an opening to the container interior;

a lid movable between (1) a closed position to cover said opening and (2) an open position to expose said opening, said lid having (a) a peripheral wall, (b) a peripheral hinge that extends from said peripheral wall, (c) a plug seal wall that extends from said peripheral hinge, and (d) a central portion that extends from said plug seal wall and that, when said lid is in said closed position, is displaceable from an outwardly projecting configuration wherein said plug seal wall is held in a non-sealing condition disengaged from said inner peripheral surface to an inwardly deformed configuration wherein said plug seal wall is held in a sealing condition sealingly engaged with said inner peripheral surface;

said combination further including a lower closure portion around said container opening below said lid, said lower closure portion being separate from, but attachable to, said container; and said lid being connected to said lower closure portion with a frangible, reduced thickness section of material;

said container top surface being annular around said opening;

said inner peripheral surface being defined inside said container below said top surface; and said non-sealing condition of said plug seal wall being further defined by the location of said plug seal wall outwardly of said container top surface when said lid is in said closed position to accommodate a tamper-evident, removable liner seal secured to said container top surface across said opening.

22. A combination of a container and a lid, said combination comprising:

a container having an inner peripheral surface around an opening to the container interior;

a lid movable between (1) a closed position to cover said opening and (2) an open position to expose said opening, said lid having (a) a peripheral wall, (b) a peripheral hinge that extends from said peripheral wall, (c) a plug seal wall that extends from said peripheral hinge, and (d) a central portion that extends from said plug seal wall and that, when said lid is in said closed position, is displaceable from an outwardly projecting configuration wherein said plug seal wall is held in a non-sealing condition disengaged from said inner peripheral surface to an inwardly deformed configuration wherein said plug seal wall is held in a sealing condition sealingly engaged with said inner peripheral surface, said lid being connected to an upper end of said container with a frangible, reduced thickness section of material.

23. A closure for a container that has an inner peripheral surface around an opening to the container interior, said closure comprising:

a lower closure portion for extending around said container opening; and a lid movable between (1) a closed position on said lower closure portion to cover said opening and (2) an open position relative to said lower closure portion to expose said opening, said lid having (a) a peripheral wall, (b) a peripheral hinge that extends from said peripheral wall, (c) a plug seal wall that extends from said peripheral hinge, and (d) a central portion that extends from said plug seal wall and that, when said lid is in said closed position, is displaceable from an outwardly projecting configuration wherein said plug seal wall is held in a non-sealing condition disengaged from said container inner peripheral surface to an inwardly deformed configuration wherein said plug seal wall is held in a sealing condition sealingly engaged with said container inner peripheral surface, said lower closure portion being molded as a unitary part of said container; and said container inner peripheral surface around said opening being defined by an annular cylindrical inner surface on said lower closure portion.

24. A closure for a container that has an inner peripheral surface around an opening to the container interior, said closure comprising:

a lower closure portion for extending around said container opening; and a lid movable between (1) a closed position on said lower closure portion to cover said opening and (2) an open position relative to said lower closure portion to expose said opening, said lid having (a) a peripheral wall, (b) a peripheral hinge that extends from said peripheral wall, (c) a plug seal wall that extends from said peripheral hinge, and (d) a central portion that extends from said plug seal wall and that, when said lid is in said closed position, is displaceable from an outwardly protecting configuration wherein said plug seal wall is held in a non-sealing condition disengaged from said container inner peripheral surface to an inwardly deformed configuration wherein said plug seal wall is held in a sealing condition sealingly engaged with said container inner peripheral surface, said lower closure portion being attached to said lid with an axis-defining hinge molded as a connection that is unitary with said lid and said lower closure portion for accommodating pivoting movement of said lid about said axis between said open and closed positions.

25. A closure for a container that has an inner peripheral surface around an opening to the container interior, said closure comprising:

a lower closure portion for extending around said container opening; and a lid movable between (1) a closed position on said lower closure portion to cover said opening and (2) an open position relative to said lower closure portion to expose said opening, said lid having (a) a peripheral wall, (b) a peripheral hinge that extends from said peripheral wall, (c) a plug seal wall that extends from said peripheral hinge, and (d) a central portion that extends from said plug seal wall and that, when said lid is in said closed position, is displaceable from an outwardly protecting configuration wherein said plug seal wall is held in a non-sealing condition disengaged from said container inner peripheral surface to an inwardly deformed configuration wherein said plug seal wall is held in a sealing condition sealingly engaged with said container inner peripheral surface, said closure lower portion also being molded as a unitary part of said container.

26. A closure for a container that has an inner peripheral surface around an opening to the container interior, said closure comprising:

a lower closure portion for extending around said container opening; and a lid movable between (1) a closed position on said lower closure portion to cover said opening and (2) an open position relative to said lower closure portion to expose said opening, said lid having (a) a peripheral wall, (b) a peripheral hinge that extends from said peripheral wall, (c) a plug seal wall that extends from said peripheral hinge, and (d) a central portion that extends from said plug seal wall and that, when said lid is in said closed position, is displaceable from an outwardly projecting configuration wherein said plug seal wall is held in a non-sealing condition disengaged from said container inner peripheral surface to an inwardly deformed configuration wherein said plug seal wall is held in a sealing condition sealingly engaged with said container inner peripheral surface, said lower closure portion and said lid each being molded as separate elements whereby said lid can be removed completely from said lower closure portion.

27. A closure in combination with a container that has an inner peripheral surface around an opening to the container, said closure comprising:

a lower closure portion for extending around said container opening; and a lid movable between (1) a closed position on said lower closure portion to cover said opening and (2) an open position relative to said lower closure portion to expose said opening, said lid having (a) a peripheral wall, (b)

a peripheral hinge that extends from said peripheral wall, (c) a plug seal wall that extends from said peripheral hinge, and (d) a central portion that extends from said plug seal wall and that, when said lid is in said closed position, is displaceable from an outwardly protecting configuration wherein said plug seal wall is held in a non-sealing condition disengaged from said container inner peripheral surface to an inwardly deformed configuration wherein said plug seal wall is held in a sealing condition sealingly engaged with said container inner peripheral surface, said container defining an annular top surface around said opening;

said container inner peripheral surface being defined inside said container below said top surface;

said lower closure portion being separate from, but attachable to, said container; and said non-sealing condition of said plug seal wall being further defined by the location of said plug seal wall outwardly of said container top surface when said lid is in said closed position to accommodate a tamper-evident, removable liner seal secured to said container top surface across said container opening.

* * * * *